United States Patent [19]

Harmon

[11] Patent Number: 5,005,809

[45] Date of Patent: Apr. 9, 1991

[54] SPRING ELEMENT FOR A FOUNDATION UNIT AND FOUNDATION UNIT EMPLOYING A SPRING ELEMENT

[75] Inventor: Lonnie R. Harmon, Carthage, Mo.

[73] Assignee: Steadley Company, Carthage, Mo.

[21] Appl. No.: 428,589

[22] Filed: Oct. 30, 1989

[51] Int. Cl.[5] ..... F16F 3/02; A47K 13/18; A47K 11/04

[52] U.S. Cl. ..... 267/103; 5/247; 5/255; 5/476; 267/107; 267/144

[58] Field of Search ..... 267/91, 103, 106, 107, 267/144; 5/247, 255, 476

[56] References Cited

U.S. PATENT DOCUMENTS

| | | | |
|---|---|---|---|
| 2,879,834 | 3/1959 | Neely | 267/106 |
| 3,953,903 | 5/1976 | Lawrence | 5/267 |
| 4,371,152 | 2/1983 | Kitchen et al. | 267/103 |
| 4,377,279 | 3/1983 | Schulz | 267/103 |
| 4,559,654 | 12/1985 | Mizelle | 5/255 |
| 4,684,111 | 8/1987 | Hagemeister | 267/103 |
| 4,770,397 | 9/1988 | Schulz | 267/144 |
| 4,862,531 | 9/1989 | Wells | 267/103 X |
| 4,867,424 | 9/1989 | Dabney | 267/103 |
| 4,903,949 | 2/1990 | Schulz, Jr. | 267/103 |

*Primary Examiner*—George E. A. Halvosa
*Attorney, Agent, or Firm*—Lee, Mann, Smith, McWilliams & Sweeney

[57] ABSTRACT

A spring element for a foundation unit and a foundation unit employing the spring element. The foundation unit is of the type having a top wire grid structure and a wooden bottom structure, with a plurality of the spring elements being disposed in space relationship between the grid structure and the bottom substructure. The spring elements include spaced support legs extending from a top portion, with the legs converging toward one another. Each leg has a series of spaced support segments, with the support segments lying generally in a single plane and extending oppositely from one another in a zig-zag fashion between the top portion and an attachment segment. Torsion segments are located between adjacent support segments, with the torsion segments extending generally perpendicular to the plane of the support legs. Suitable links are used to interconnect each torsion segment with its adjacent support segments of each support leg.

17 Claims, 1 Drawing Sheet

SPRING ELEMENT FOR A FOUNDATION UNIT AND FOUNDATION UNIT EMPLOYING A SPRING ELEMENT

BACKGROUND OF THE INVENTION

This invention relates to foundation units, often known as box springs, and more particularly to a spring element for a foundation unit, and the resulting foundation unit, the spring element being composed of a bent wire member with torsion segments rather than a coventional coil spring.

Foundation units of the type of the present invention are typically composed of coil springs mounted on a wooden frame which are reinforced and held in place by a grid wire top bearing structure. Coils are secured to the grid wire top bearing structure by a series of clips, pigtail wires or the like, or, as described in U.S. Pat. No. 3,953,903, assigned to the assignee of the present application, the coil springs may be snapped into a specially formed grid wire top bearing structure. However, the foundation unit of U.S. Pat. No. 3,953,903 employs conventional coil springs, which, although quite satisfactory for many applications, tend not to provide desired support under all load conditions. Therefore, other types of wire elements, such as those illustrated in U.S. Pat. Nos. 4,377,279 and 4,770,397, have been developed, the elements having a full range of characteristics from no spring whatsoever to coil spring-like characteristics.

SUMMARY OF THE INVENTION

The invention provides a spring element for a foundation unit and a foundation unit itself employing the spring element, the foundation unit being of the type having a wire top bearing structure and a rigid bottom substructure, with a plurality of the spring elements being disposed in spaced relationship between the top bearing structure and the bottom substructure. Each spring element is formed of a top portion and a pair of spaced support legs extending from the top portion and converging toward one another. The top portion includes means for attachment to the wire top, and each support leg comprises a series of spaced support segments, the support segments of each support leg lying generally in a single plane. Adjacent support segments are oppositely directed from one another, and at least one of the support segments is downwardly inclined in order to give the spring element sufficient depth. A torsion segment is located between adjacent ones of the support segments at the ends thereof, each of the torsion segments of each support leg extending generally perpendicular to the single plane of the support leg. Means is also provided for interconnecting each torsion segment and its adjacent support segments.

In accordance with the preferred embodiment of the invention, each support leg of the pair of support legs of each spring element is complementary to the other support leg of each of the pair of support legs such that the spring element is balanced in compression. Each of the torsion segments comprises a generally straight wire member, with the center of each torsion segment of each support leg being located generally in the plane of the leg.

The torsion segments are interconnected with the support segments of each support leg by means of offset links extending from each support segment to one end of the associated adjacent torsion segment. In accordance with the preferred form of the invention, the spring element comprises a continuous wire member, and therefore all portions thereof are bends formed in the wire member.

The top portion of the spring element comprises a Z-shaped member having spaced, parallel attachment legs and a diagonal interconnecting link, with each of the attachment legs being connected at one end to one of the support legs at an upper support segment thereof. The thus-formed top portion may snap into a grid wire top bearing structure such as that of U.S. Pat. No. 3,953,903.

BRIEF DESCRIPTION OF THE DRAWING

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figures 1, 2, 3, 4:
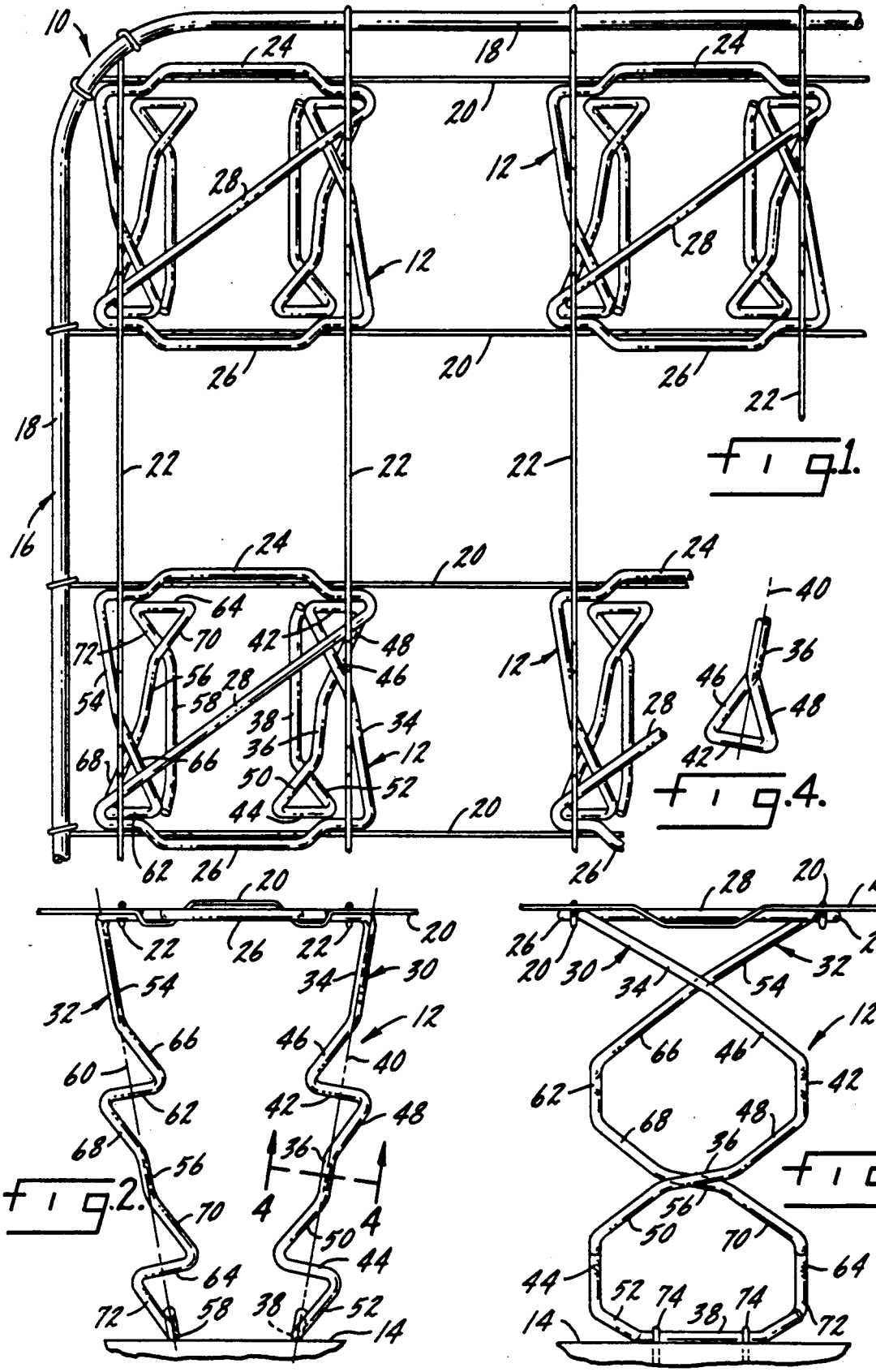
FIG. 1 is a top plan view of a corner portion of a foundation unit according to the invention employing spring elements according to the invention.
FIG. 2 is a side elevational view of one of the spring elements of the foundation unit of FIG. 1, viewed, in relation to FIG. 1, either from the top or the bottom of the FIGURE.
FIG. 3 is a side elevational view of one of the spring elements of the foundation unit of FIG. 1, viewed, in relation to FIG. 1, from either the left or the right of one of the spring elements.
FIG. 4 is a partial cross-sectional view taken along lines 4—4 of FIG. 2.

A foundation unit 10 employing a spring element 12 according to the invention is shown partly in FIG. 1. The foundation unit 10 is similar to conventional foundation units, and therefore only a corner thereof has been shown in the drawing figures, it being well known that a complete foundation unit would employ a plurality of parallel rows and columns of the spring elements 12.

The foundation unit 10 employs, in addition to the spring elements 12, a bottom frame 14 (portions thereof shown in FIGS. 2 and 3) and the top frame in the form of a coil spring supporting grid wire top bearing structure 16. The bottom frame 14 may be of conventional wooden construction, having a plurality of extending coil support members which are attached to and extend between opposite sides of the foundation unit 10. The top bearing structure 16 preferably is that of U.S. Pat. No. 3,953,903, the disclosure of which is incorporated herein by reference, although the top bearing structure 16 can also be composed of practically any grid wire top bearing structure having spaced grid wires secured to a perimeter border 18. For the purposes of description herein, the top bearing structure 16 comprises, in addition to the perimeter border 18, spaced longitudinal wires 20 and spaced transverse wires 22, the roles of which obviously may be reversed depending on the ultimate dimensions of the foundation unit 10.

Each of the spring elements 12 is composed of a top portion from which a pair of converging spaced support legs extend. Turning first to FIG. 1, the top portion of each of the spring elements 12 is generally Z-shaped in configuration, and is composed of spaced, parallel attachment legs 24 and 26 and an integral, diagonal interconnecting link 28. Each of the legs 24 and 26 has a portion that extends outwardly from the body of the spring element 12, as shown, in order to engage the respective longitudinal wire 20 to which the spring element 12 is attached. Further detail regarding the means of attachment and formation of the wires 20 and 22 is found in referenced U.S. Pat. No. 3,953,903.

Connected to the opposite attachment legs 24 and 26 are integral extending support legs 30 and 32. As best shown in FIGS. 2 and 3, the support leg 30 is composed of a series of spaced support segments 34, 36 and 38 in a zig-zag fashion, the latter of which also serves as a location for attachment to the bottom substructure 14. The segments 34, 36 and 38 lie essentially in a single plane perpendicular to the page in FIG. 2, and oblique to the page in FIG. 3. A plane 40 encompassing the support segments 34, 36 and 38 is shown in phantom in FIG. 2.

Torsion segments 42 and 44 are located between adjacent support segments, the torsion segment 42 being located between the support segments 34 and 36, and the torsion segment 44 being located between the support segments 36 and 38. The torsion segments 42 and 44 compose straight wire portions of the support leg 30, and extend generally perpendicular to the plane 40, as best shown in FIG. 2.

The support leg 30 is balanced, in that each of the torsion segments 42 and 44 is located with its center passing through the plane 40, as again best shown in FIG. 2. In order to accomodate the transverse orientation of the torsion segments 42 and 44, and interconnect the torsion segments with the support segments, a series of offset links are formed in the leg 30. A first offset link 46 extends between the support segment 34 and the torsion segment 42. A second offset link 48 extends between the torsion segment 42 and the support segment 36. A third offset link 50 extends between the support segment 36 and the torsion segment 44. A fourth and final offset link 52 extends between the torsion segment 44 and the support segment 38. Thus, the support segments 34 through 38 lie in the plane 40, while the torsion segments 42 and 44 pass through the plane 40 and have equal portions on opposite sides thereof. The offset links 46 through 52 alternate on opposite sides of the plane 40, thus creating total symmetry in relation to the plane 40 and assuring that the leg 30 is balanced in compression, and does not bow appreciably out of the plane 40 when compressed.

The leg 32 is identical to the leg 30, being oriented at a mirror image thereof. The leg 32 includes three support segments 54, 56 and 58 lying in a single plane 60, a pair of torsion segments 62 and 64 perpendicular to the plane 60, and four offset links 66, 68, 70 and 72 interconnecting the respective support segments and torsion segments. The function of the support leg 32 is identical to that of the support leg 30, but since the legs 30 and 32 are oriented at mirror images to one another, not only is each of the legs internally balanced, but also the spring element 12 is balanced by the legs 30 and 32 so that compression without twisting or wracking of the spring element 12 always occurs.

As shown in FIG. 3, each spring element 12 is affixed to the wooden bottom substructure 14 by means of a series of staples 74, two staples 74 attaching each of the support segments 38 and 58 to the substructure 14. As is well known, other means of attachment other than staples 74 may be utilized, and forms no part of the invention.

The foundation unit 10 is assembled in a conventional fashion, using the bottom substructure 14, top bearing structure 16, and a plurality of the spring elements 12. One method of assembly is to staple the spring elements 12 in place to the bottom substructure 14. The top bearing structure 16 is then laid in place, and the spring elements 12 are snapped into the grid of the top bearing structure 16 in a fashion similar to that explained in referenced U.S. Pat. No. 3,953,903. A second method of assembly is to snap the spring elements 12 into the top bearing structure 16. The top bearing structure 16 with spring elements 12 is then placed over the bottom substructure 14 in registration therewith, and the spring elements 12 are then stapled to the bottom substructure 14. Thereafter, padding is applied to the top of the top bearing structure 16, and an appropriate cloth cover is applied to the foundation unit 10 and stapled or otherwise attached to the bottom substructure 14 to complete the foundation unit.

The torsion segments 42, 44, 62 and 64 provide the compressible spring action for each of the spring elements 12. As a spring element 12 is compressed, the elements 42, 44, 62 and 64 twist axially, and once any load is removed from the spring element 12, stored force due to the twisted torsion segments returns the spring element 12 to its relaxed orientation.

Various changes can be made to the invention without departing from the spirit thereof or scope of the following claims.

What is claimed is:

1. A spring element for a foundation unit of the type having a wire top bearing structure and a rigid bottom substructure, a plurality of the spring elements being disposed in spaced relationship between the top bearing structure and the bottom substructure, the spring element comprising a. a top portion and a pair of spaced support legs extending from said top portion and converging toward one another, b. said top portion including means for attachment to the wire top, c. each support leg comprising a series of spaced support segments, said support segments of each support leg lying generally in a single plane, adjacent support segments being oppositely directed from one another and at least one of said support segments being downwardly inclined, d. a torsion segment located between adjacent ones of said support segments at the ends thereof, each said torsion segment extending generally perpendicular to said single plane, each torsion segment comprising a generally straight wire member with the center of each torsion segment of each said support leg being located generally in said single plane, and e. means interconnecting each torsion segment and said adjacent support segments.

2. A spring element according to claim 1 in which each support leg of said pair of support legs is complementary to the other support leg of said pair of support legs such that said spring element is balanced in compression.

3. A spring element according to claim 1 in which said interconnecting means comprises an offset link extending from each support segment adjacent a torsion segment to one end of said adjacent torsion segment.

4. A spring element according to claim 1 in which said spring element comprises a continuous wire member.

5. A spring element according to claim 4 in which said interconnecting means comprises an offset link extending from each support segment adjacent a torsion segment to one end of said adjacent torsion segment.

6. A spring element according to claim 1 in which said top portion comprises a Z-shaped member having spaced, parallel attachment legs and a diagonal interconnecting link, each of said attachment legs being connected at one end to one of said support legs at an upper support segment thereof.

7. A spring element according to claim 6 in which said spring element comprises a continuous wire member.

8. A spring element for a foundation unit of the type having a wire top bearing structure and a rigid bottom substructure, a plurality of the spring elements being disposed in spaced relationship between the top bearing structure and the bottom substructure, the spring element being composed of a continuous wire member and comprising a. a top portion and a pair of spaced support legs extending from said top portion and converging toward one another, b. said top portion including means for attachment to the wire top, c. each support leg comprising a series of spaced support segments, said support segments of each support leg lying generally in a single plane, at least some of the adjacent support segments of each support leg being oppositely directed from one another and being downwardly inclined, d. a torsion segment located between adjacent ones of said support segments at the ends thereof, each said torsion segment extending generally perpendicular to said single plane, and each torsion segment comprising a generally straight member with the center of each torsion segment of each said leg being located generally in said single plane of said leg, and e. an offset link extending from each support segment adjacent a torsion segment to one end of said adjacent torsion segment to interconnect each torsion segment and said adjacent support segment.

9. A spring element according to claim 8 in which each support leg of said pair of support legs is complementary to the other support leg of said pair of support legs such that said spring element is balanced in compression.

10. A spring element according to claim 8 in which said top portion comprises a Z-shaped member having spaced, parallel attachment legs and a diagonal interconnecting link, each of said attachment legs being connected at one end to one of said support legs at an upper support segment thereof.

11. A foundation unit of the type having a wire top bearing structure and a rigid bottom substructure, and having a plurality of spring elements disposed in spaced relationship between the top bearing structure and the bottom substructure, each of said spring elements comprising a. a top portion and a pair of spaced support legs extending from said top portion and converging toward one another, b. each support leg comprising a series of spaced support segments, said support segments of each support leg lying generally in a single plane, at least some of the adjacent support segments of each support leg being oppositely directed from one another and being downwardly inclined, c. a torsion segment located between adjacent ones of said support segments at the ends thereof, each said torsion segment extending generally perpendicular to said single plane, and each torsion segment comprising a generally straight member with the center of each torsion segment of each said leg being located generally in said single plane of said leg, and d. means interconnecting each torsion segment and said adjacent support segments.

12. A foundation unit according to claim 11 in which each support leg of said pair of support legs is complementary to the other support leg of said pair of support legs such that said spring element is balanced in compression.

13. A foundation unit acording to claim 11 in which said interconnecting means comprises an offset link extending from each support segment adjacent a torsion segment to one end of said adjacent torsion segment.

14. A foundation unit according to claim 11 in which said spring element comprises a continuous wire member.

15. A foundation unit according to claim 14 in which said interconnecting means comprises an offset link extending from each support segment adjacent a torsion segment to one end of said adjacent torsion segment.

16. A foundation unit according to claim 11 in which said top portion includes means for attachment to the wire top.

17. A foundation unit according to claim 16 in which said top portion comprises a Z-shaped member having spaced, parallel attachment legs and a diagonal interconnecting link, each of said attachment legs being connected at one end to one of said support legs at an upper support segment thereof.

* * * * *